US011542691B2

(12) United States Patent
Porter

(10) Patent No.: US 11,542,691 B2
(45) Date of Patent: Jan. 3, 2023

(54) FAUCET HOSE ADAPTER

(71) Applicant: Tiffany Porter, South Lake Tahoe, CA (US)

(72) Inventor: Tiffany Porter, South Lake Tahoe, CA (US)

( * ) Notice: Subject to any disclaimer, the term of this patent is extended or adjusted under 35 U.S.C. 154(b) by 358 days.

(21) Appl. No.: 16/845,430

(22) Filed: Apr. 10, 2020

(65) Prior Publication Data

US 2020/0325663 A1 Oct. 15, 2020

Related U.S. Application Data

(60) Provisional application No. 62/831,977, filed on Apr. 10, 2019.

(51) Int. Cl.
*E03C 1/04* (2006.01)

(52) U.S. Cl.
CPC .... *E03C 1/0404* (2013.01); *E03C 2001/0414* (2013.01); *Y10T 137/9464* (2015.04)

(58) Field of Classification Search
CPC ..... E03C 1/0404; E03C 2001/0414; E03C 1/086; E03C 2001/0415; E03C 2001/0416; Y10T 137/9464; A47K 3/005
USPC ..... 137/801
See application file for complete search history.

(56) References Cited

U.S. PATENT DOCUMENTS 1,000,414 A 8/1911 Kintner
1,217,597 A * 2/1917 Hecht ..... A46B 11/066 401/289
2,171,023 A * 8/1939 Buxton ..... E03C 1/08 239/602
3,638,968 A 2/1972 Barks
4,353,139 A * 10/1982 Wainwright ..... A47K 3/001 239/602
D282,563 S * 2/1986 Beene ..... D21/616
4,709,429 A * 12/1987 Lerner ..... A47K 3/005 4/DIG. 18
D298,161 S * 10/1988 Garcia ..... D21/616
4,821,960 A * 4/1989 Goldman ..... B05B 1/18 239/602
D354,550 S * 1/1995 Munoz ..... D23/256
6,205,598 B1 * 3/2001 Black ..... A47K 3/001 4/DIG. 18
6,425,149 B1 7/2002 Wang
D465,009 S * 10/2002 Siefken ..... A47K 3/005 D21/616
D501,040 S * 1/2005 Gieson ..... A47K 3/005 D23/222
7,344,094 B1 * 3/2008 Tracy ..... E03C 1/08 239/602
D612,492 S * 3/2010 Krumins ..... D21/616
8,424,129 B2 * 4/2013 Henderson ..... A47K 3/005 4/661
D691,699 S * 10/2013 Berger ..... D23/213
9,216,425 B2 * 12/2015 Ojea ..... E03C 1/086
(Continued)

*Primary Examiner* — Daphne M Barry
(74) *Attorney, Agent, or Firm* — Boudwin Intellectual Property; Daniel Boudwin

(57) ABSTRACT

A faucet hose adapter includes an elongated tube having a first end opposite a second end defining a channel therebetween. The first end is dimensioned to secure over a faucet such that fluid dispensed from the faucet exits through the second end. An aperture is disposed through the elongated tube adjacent to the first end, wherein the aperture can receive a faucet valve handle therethrough.

18 Claims, 4 Drawing Sheets

(56) References Cited

U.S. PATENT DOCUMENTS

| | | | | |
|---|---|---|---|---|
| 9,803,343 | B2 | 10/2017 | Montoya | |
| 9,982,421 | B2 * | 5/2018 | DiDea | E03C 1/0404 |
| 10,584,468 | B2 * | 3/2020 | DiDea | F16L 25/14 |
| D928,913 | S * | 8/2021 | Pant | D23/222 |
| D937,989 | S * | 12/2021 | Jin | D23/256 |
| D940,821 | S * | 1/2022 | Xu | D23/215 |
| 2006/0227850 | A1 * | 10/2006 | Johnson | G01K 1/14 374/E1.019 |
| 2007/0277891 | A1 * | 12/2007 | Frankel | A47K 3/005 137/625 |
| 2008/0196159 | A1 * | 8/2008 | Lee | F16K 31/607 4/678 |
| 2011/0127301 | A1 * | 6/2011 | Weber | E03C 1/086 137/801 |
| 2017/0275858 | A1 * | 9/2017 | DiDea | E03C 1/021 |
| 2019/0059658 | A1 * | 2/2019 | Gharibian | A47K 3/005 |
| 2019/0090696 | A1 * | 3/2019 | Zeanah | A47K 3/005 |
| 2021/0372101 | A1 * | 12/2021 | Fazio | E03C 1/0404 |

* cited by examiner

FAUCET HOSE ADAPTER

CROSS REFERENCE TO RELATED APPLICATIONS

This application claims the benefit of U.S. Provisional Application No. 62/831,977 filed on Apr. 10, 2019. The above identified patent application is herein incorporated by reference in its entirety to provide continuity of disclosure.

BACKGROUND OF THE INVENTION

The present invention relates to faucet hose adapters. More particularly, the present invention pertains to a bathtub faucet hose adapter having an aperture configured to receive a faucet valve handle therethrough.

Many individuals must bathe children or pets, which is often difficult to manage in a traditional bathtub. Children and pets can be notoriously difficult to control in a bath, often becoming agitated. When agitated, the child or pet can cause a significant mess, splashing water outside of the bath, which can risk slip and fall injuries if not cleaned properly. Typically, pets and children require attention or entertainment to serve as a distraction to prevent frustration leading to misbehaving.

Additionally, traditional bathtub faucets are not capable of readily directing water flow towards the bather. As such, the user must collect water from the faucet in a container to then pour over the bather. The time required to collect water in this way can further cause discomfort or agitation in the bather, as the user is unable to properly entertain or pay attention to the bather at that time. Spray nozzle adapters that can extend the flow of water from the bathtub faucet can be particularly useful in directing a consistent flow of water towards the bather, however these adapters typically affix to a faucet outlet, which can result in an inadequate seal, causing leaks that reduce water pressure at the nozzle outlet. Additionally, these adapters are incapable of affixing about an exterior of a variety of bathtub faucet to prevent leaks, while also providing access to the faucet valve handle. Therefore, a device that can provide access to a faucet valve handle while securing about a faucet valve handle is desired. Additionally, an adapter that can further entertain a child is desired.

In light of the devices disclosed in the known art, it is submitted that the present invention substantially diverges in design elements from the known art and consequently it is clear that there is a need in the art for an improvement to existing bathtub faucet hose adapters. In this regard, the instant invention substantially fulfills these needs.

SUMMARY OF THE INVENTION

In view of the foregoing disadvantages inherent in the known types of faucet hose adapters now present in the known art, the present invention provides a faucet hose adapter wherein the same can be utilized for providing convenience for the user when extending the range of a traditional faucet while allowing easy access to the faucet valve handle.

The present system comprises a flexible elongated tube having a first end opposite a second end defining a channel therebetween, wherein the first end is dimensioned to secure over a faucet such that fluid dispensed from the faucet exits through the second end, An aperture is disposed through the elongated tube adjacent to the first end, wherein the aperture is configured to receive a faucet valve handle therethrough.

In some embodiments, the first end comprises an elastic material configured to selectively move between an expanded position and a retracted position, wherein the first end frictionally engages the faucet when in the retracted position. In this manner, the first end can expand to secure over faucets of various sizes while retracting to frictionally engage an exterior surface of the faucet, such that the elongated tube is removably secured thereto, in another embodiment, a rigid collar is disposed within the channel, wherein the rigid collar is configured to prevent flexion of the elongated tube about the faucet. In this manner, the rigid collar prevents kinks at the faucet outlet, ensuring that the flow of water is maintained at a constant rate. Additionally, the rigid collar serves to prevent the elongated tube from flexing significantly in response to the outlet flow of water from the faucet, ensuring maximal control of the elongated tube is maintained. In other embodiments, a flexibility of the elongated tube varies along a length thereof, such that the flexibility at the second end is greater than at the first end. In this manner, the first end is more rigid than the second end, such that control of the elongated tube is maintained, while allowing the user to properly position the second end as needed during use.

In another embodiment, a spray nozzle is affixed to the second end, wherein the spray nozzle comprises a plurality of openings on a distal end thereof, such that the plurality of openings distribute the outlet flow of water across a larger area, similar to a shower head. In some such embodiments, a proximal end of the spray nozzle comprises a smaller diameter than the distal end thereof, such that the area of water flow coverage is increased relative to the water flow coverage through the second end of the elongated tube. In another embodiment, the proximal end of the spray nozzle is removably securable to the second end such that the various spray nozzles and attachments can be interchangeably affixed to the elongated tube. In yet another embodiment, a sponge attachment is removably securable to the second end, wherein the sponge attachment is in fluid communication with the second end, allowing water dispensed therefrom to permeate the sponge attachment.

In other embodiments, a rigid base having an opening therethrough affixed to the first end of the elongated tube, such that the first end is secured about the opening. In this way, the faucet can be inserted through the opening and into the first end of the elongated tube. In some embodiments, the rigid base comprises a planar rear surface configured to rest flush against a wall surface, such that the rigid base is stabilized thereby. In another embodiment, a front surface of the rigid base comprises indicia thereon, wherein the indicia are configured to entertain a child, such as replicating a face, character, or the like. In yet another embodiment, the rigid base is shaped to resemble an animal or other character to further aid in child entertainment.

BRIEF DESCRIPTION OF THE DRAWINGS

Although the characteristic features of this invention will be particularly pointed out in the claims, the invention itself and manner in which it may be made and used may be better understood after a review of the following, description, taken in connection with the accompanying drawings wherein like numeral annotations are provided throughout.

DETAILED DESCRIPTION OF THE INVENTION

Figure 1:
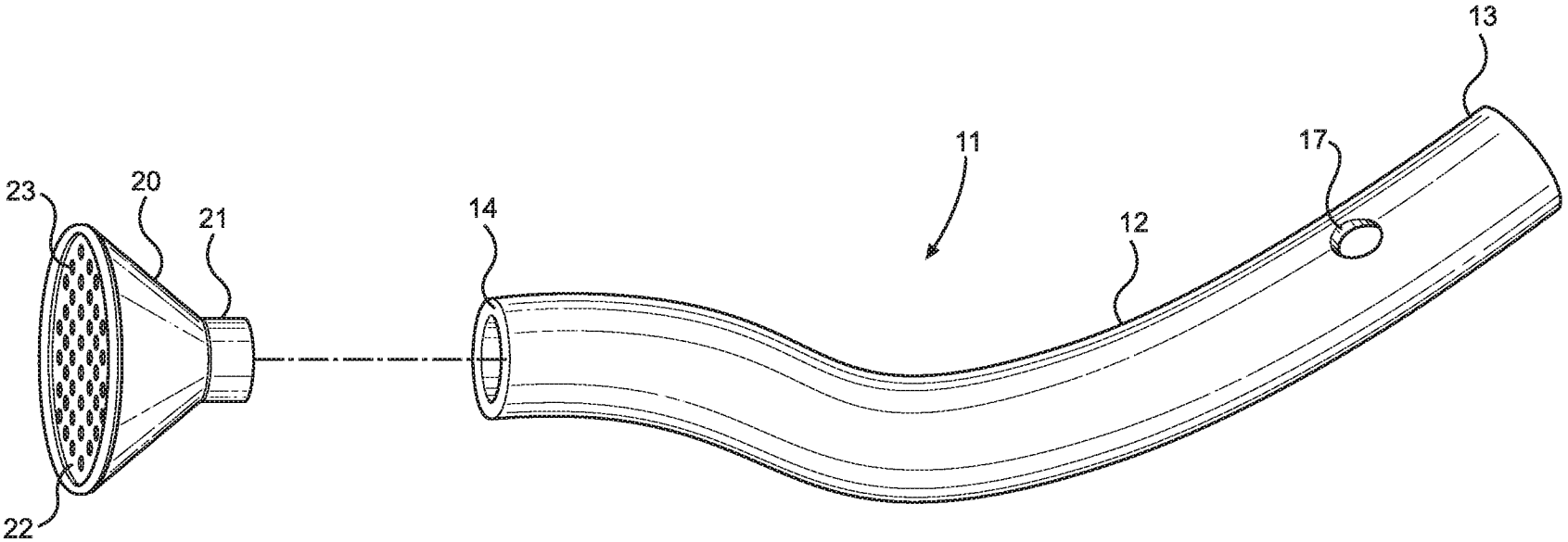
FIG. 1 shows an exploded view of an embodiment of the faucet hose adapter.

Reference is made herein to the attached drawings. Like reference numerals are used throughout the drawings to depict like or similar elements of the faucet hose adapter. The figures are intended for representative purposes only and should not be considered to be limiting in any respect.

Figure 2:
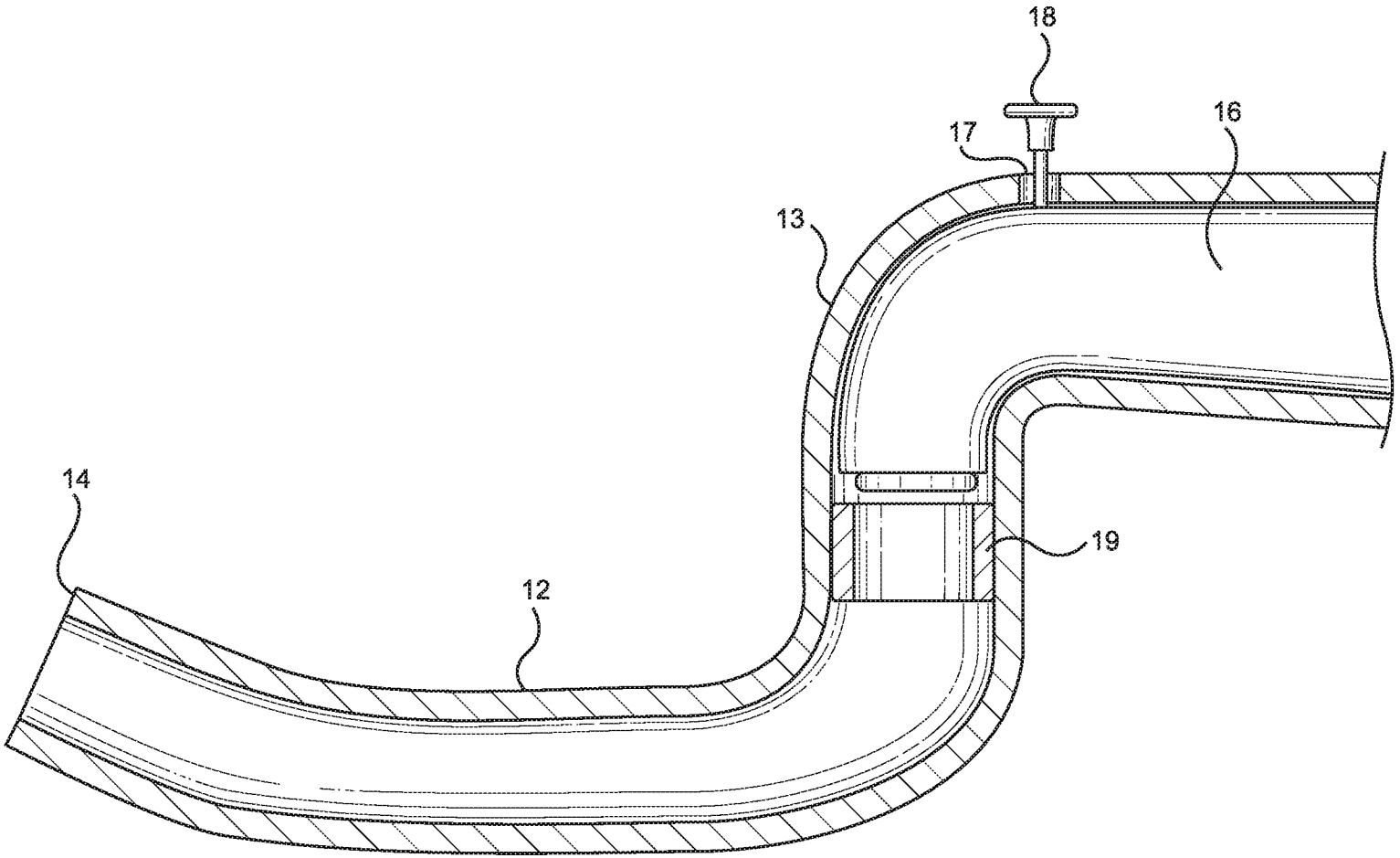
FIG. 2 shows a cross-sectional view of an embodiment of the faucet hose adapter secured to a faucet.

Referring now to FIG. 1, there is shown an exploded view of an embodiment of the faucet hose adapter. The faucet hose adapter 11 comprises an elongated flexible tube 12, wherein the elongated tube 12 comprises a first end 13 disposed opposite a second end 14, defining a channel therebetween. The first end 13 is configured to secure over a faucet (as shown in FIG. 2, 16) such that water emitted from the faucet travels through the channel and exits through the second end 14, hi this manner, the flow of water is extended from the faucet, allowing, the user to selectively direct the flow of water where desired. The elongated tube 12 can comprise a variety of flexible and durable materials, such as, but not limited to silicon, latex, and the like. In the illustrated embodiment, the elongated tube 12 further comprises an aperture 17 therethrough, wherein the aperture 17 is disposed adjacent to the first end 13, such that a faucet valve handle (as shown in FIG. 2, 18) can extend therethrough.

In the illustrated embodiment, a spray nozzle 20 is removably securable to the second end 14, such that the user can disperse water emitted from the second end 14 across a wider area. In the shown embodiment, the spray nozzle 20 comprises a proximal end 21 opposite a distal end 22, wherein the distal end 22 comprises a plurality of openings 23 therethrough, in this manner, the plurality of openings 23 are configured to disperse water across a larger area, similar to a showerhead. In the shown embodiment, the proximal end 21 comprises a smaller diameter than that of the distal end 22, such that the proximal end 21 comprises a similar diameter to that of the second end 14. In some embodiments, the spray nozzle 20 is permanently affixed to the second end 14, whereas in alternate embodiment, the spray nozzle 20 is removably secured to the second end 14, such that the spray nozzle 20 is interchangeable with alternate attachments. In such embodiments, the spray nozzle 20 is contemplated to be removably securable to the second end 14 via frictional engagement, wherein the proximal end 21 frictionally engages within the second end 14 of the elongated tube 12, or alternately about an exterior of the second end 14, In this manner, a watertight seal can be formed between the second end 14 and the proximal end 21, such that water does not leak from an interface therebetween. Alternatively, in other embodiments, the proximal end 21 further comprises threading thereon configured to engage complementary threading disposed on the second end 14, such that the spray nozzle 20 is removably secured thereto.

Referring now to FIG. 2, there is shown a cross-sectional view of an embodiment of the faucet hose adapter secured to a faucet. In the illustrated embodiment, the elongated tube 12 is removably secured to the faucet 16, such that the first end 13 is frictionally engaged therewith. In some embodiments, the first end 13 comprises elastic materials configured to selectively move between an expanded position and a retracted position, such that the first end 13 is removably securable over a variety of faucet sizes. When in the retracted position, the first end 13 is configured to frictionally engage an exterior of the faucet to secure the elongated tube 12 thereto. In such embodiments, the force of engagement is sufficient to overcome the force of water exiting the faucet, such that the elongated tube 12 is retained on the faucet when water is flowing therefrom. In the shown embodiment, the faucet valve handle 18 is disposed through the aperture 17, such that a user can readily access the faucet valve handle 18 to adjust the flow of water through the faucet 16. Additionally, the faucet valve handle 18 serves as an anchor for the first end 13, such that the first end 13 is further secured to the faucet 16 to resist the force of water exiting the faucet 16.

In the illustrated embodiment, the elongated tube 12 further comprises a rigid collar 19 disposed within the channel adjacent to the first end 13, such that the rigid collar 19 is disposed at an outlet of the faucet 16. The rigid collar 19 is configured to prevent flexion of the elongated tube 12 about the first end 13, in this manner, the elongated tube 12 is prevented from collapsing adjacent to the outlet of the faucet 16, such that the flow of water is unimpeded. Additionally, the elongated tube 12 is further prevented from moving in an uncontrolled fashion due to high pressure water from the faucet 16, such that the second end 14 of the tube is prevented from flailing about. In other embodiments, a flexibility of the elongated tube 12 varies along a length thereof, such that a flexibility of the elongated tube 12 is greater at the second end 14 than at the first end 13. In this manner, the elongated tube 12 is provided similar benefits described above for embodiments having the rigid collar 19, while minimizing complexity of manufacture.

Figure 3A:
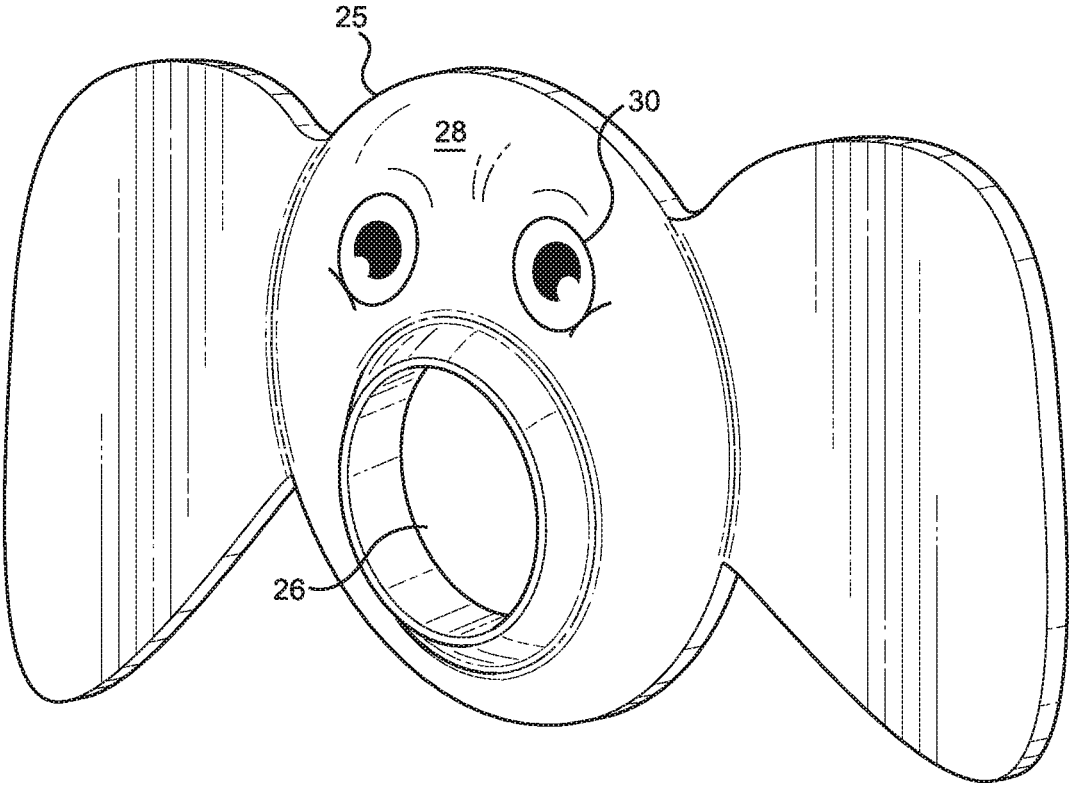
FIG. 3A shows a front perspective view of the rigid base of an embodiment of the faucet hose adapter.
Figure 3B:
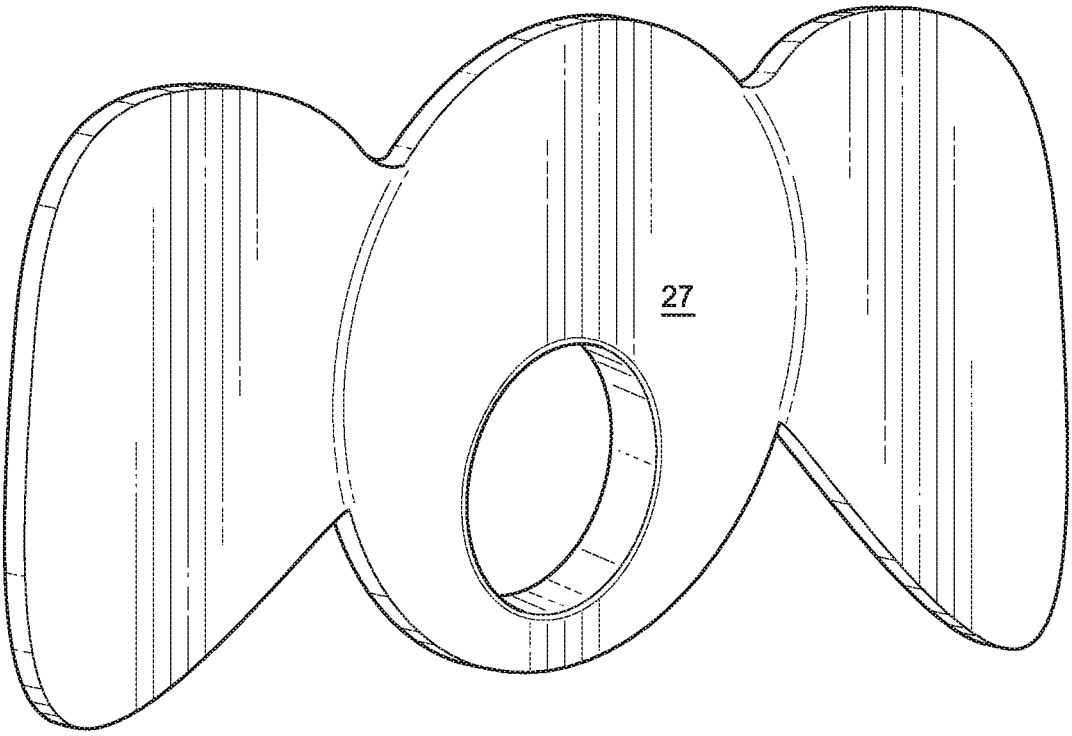
FIG. 3B shows a rear perspective view of the rigid base of an embodiment of the faucet hose adapter.

Referring now to FIGS. 3A and 3B, there is shown a front perspective view of the rigid base of an embodiment of the faucet hose adapter and a rear perspective view of the rigid base of an embodiment of the faucet hose adapter, respectively. In the shown embodiment, the faucet hose adapter further comprises a rigid base 25. The rigid base 25 includes an opening 26 therethrough, wherein the opening 26 is configured to receive the first end of the elongated tube thereon. The rigid base 25 serves several purposes, such as providing a gripping surface for a user to apply the faucet hose adapter to an existing faucet, such that the user does not struggle with maintaining the first end of the elongated tube in an expanded position to secure over the faucet.

Figure 4:
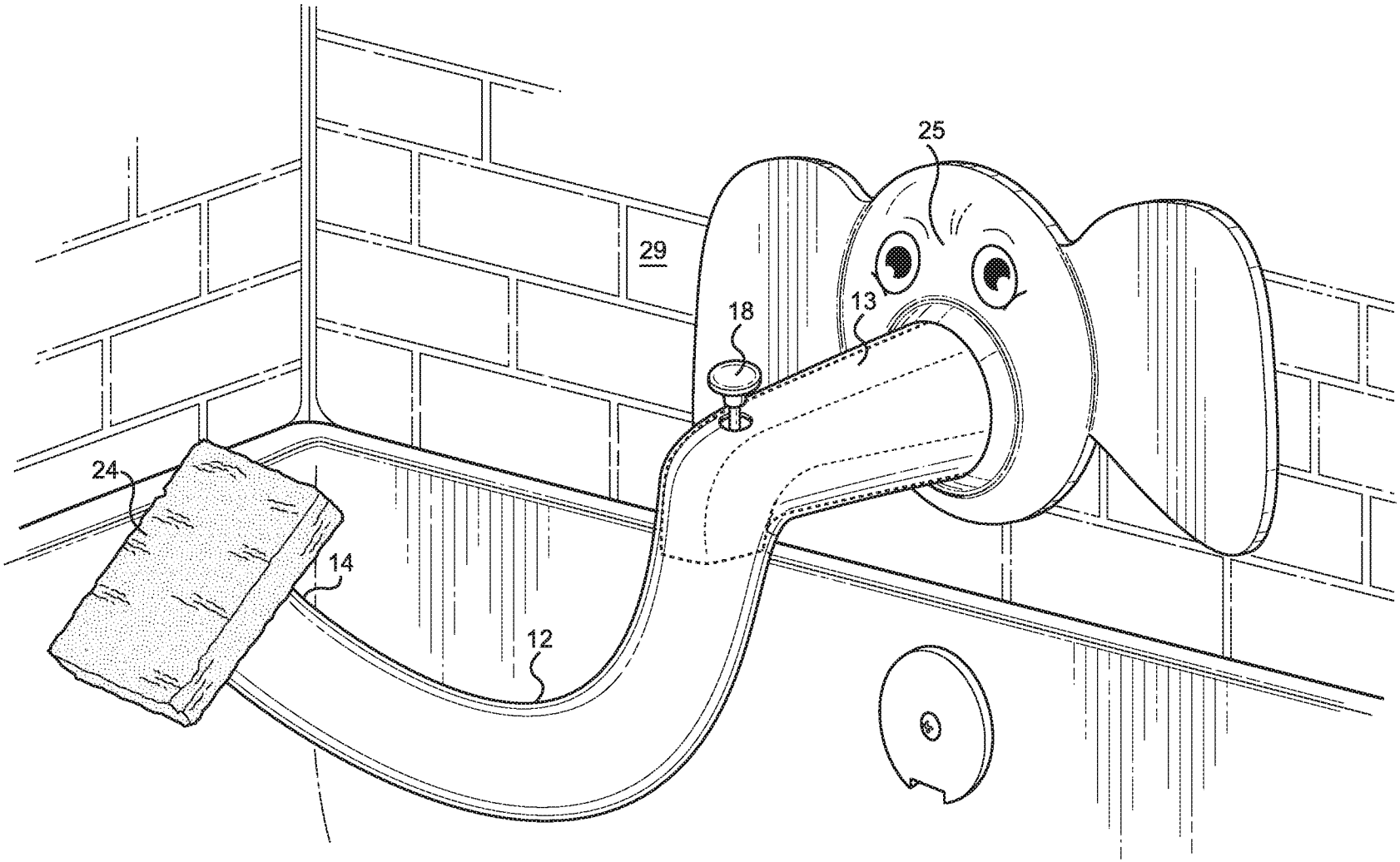
FIG. 4 shows a perspective view of an embodiment of the faucet hose adapter in use.

Additionally, in the shown embodiments, the rigid base 25 is dimensioned to simulate the shape of an animal or other entertaining character, such that when the faucet hose adapter is in use for bathing a child, the rigid base 25 can entertain the child and reduce stress and effort required by the parent. In the shown embodiment, the rigid base 25 comprises a shape of an elephant, such that the elongated tube replicates a trunk of the elephant, however alternate animals or entertaining characters are contemplated. In the illustrated embodiment, the rigid base 25 of the shown embodiment further comprises indicia 30 on a front surface 28 thereof, such that the indicia 30 represent facial features of the animal, further aiding in entertainment capabilities. In the shown embodiment of FIG. 3B, a rear surface 27 of the rigid base 25 comprises a planar surface, such that the rear surface 27 rests flush against a wall surface (as shown in FIG. 4, 29) when the rigid base 25 is secured to a faucet. In this manner, the rigid base 25 anchors and stabilizes the faucet hose adapter against a wall surface.

Referring now to FIG. 4, there is shown a perspective view of an embodiment of the faucet hose adapter in use. In one use, the first end 13 is secured over a faucet such that the faucet valve handle 18 extends through the aperture. In the shown embodiment, the rigid base 25 is placed against the wall surface 29 such that the rigid base 25 is stabilized thereagainst to maintain the rigid base 25 in an upright position, ensuring maximal visibility for a child. As water exits the faucet, the water is guided through the channel to exit through the second end 14 thereof. In the illustrated embodiment, the second end 14 further comprises a sponge attachment 24 disposed thereon, wherein the sponge attachment 24 is in fluid communication with the second end 14. In this manner, the water can permeate the sponge attachment 24 to enable efficient scrubbing therewith. The user can selectively attach the sponge attachment 24, the spray nozzle, or additional attachments for cleaning purposes thereon. In this manner, the user can interchange attachments to aid in cleaning in a desired fashion.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A faucet hose adapter, comprising:

a flexible elongated tube having a first end opposite a second end defining a channel therebetween;

wherein the first end defines a singular inlet opening therethrough, and wherein the outlet defines a singular outlet opening therethrough;

wherein the first end is dimensioned to secure over a faucet, such that fluid dispensed from the faucet exits through the second end;

an aperture disposed through the elongated tube adjacent to the first end, wherein the aperture is configured to receive a faucet valve handle therethrough; and a rigid collar having a passage centrally disposed therethrough, wherein the rigid collar is coaxially disposed within the channel between the second end and the aperture, such that the rigid collar is disposed adjacent to an outlet of the faucet when the first end is secured to the outlet of the faucet.

2. The faucet hose adapter of claim 1, wherein the first end comprises an elastic material configured to selectively move between an expanded position and a retracted position, wherein a diameter of the first end is greater when the first end is in the expanded position, such that the first end frictionally engages the faucet when in the retracted position.

3. The faucet hose adapter of claim 1, further comprising a spray nozzle affixed to the second end, wherein the spray nozzle comprises a plurality of openings on a distal end of the spray nozzle.

4. The faucet hose adapter of claim 3, wherein a proximal end of the spray nozzle comprises a smaller diameter than the distal end of the spray nozzle.

5. The faucet hose adapter of claim 3, wherein a proximal end of the spray nozzle is removably securable to the second end.

6. The faucet hose adapter of claim 1, wherein a flexibility of the elongated tube varies along a length of the elongated tube, such that the flexibility at the second end is greater than at the first end.

7. The faucet hose adapter of claim 1, further comprising a sponge attachment removably securable to the second end.

8. The faucet hose adapter of claim 1, wherein the elongated tube comprises a consistent diameter along an entire length.

9. A faucet hose adapter, comprising:

a flexible elongated tube having a first end opposite a second end defining a channel therebetween;

wherein the first end defines a singular inlet opening therethrough, and wherein the outlet defines a singular outlet opening therethrough;

a rigid base having an opening therethrough such that the rigid base encircles the opening about an entire circumference of the opening;

wherein the opening extends between a front face of the rigid base and a rear face of the rigid base and is dimensioned to receive a faucet therethrough;

wherein the first end is affixed to the rigid base about the opening;

wherein the first end is dimensioned to secure over the faucet, such that fluid dispensed from the faucet exits through the second end;

an aperture disposed through the elongated tube adjacent to the first end, wherein the aperture is configured to receive a faucet valve handle therethrough; and a rigid collar having a passage centrally disposed therethrough, wherein the rigid collar is coaxially disposed within the channel between the second end and the aperture, such that the rigid collar is disposed adjacent to an outlet of the faucet when the first end is secured to the outlet of the faucet.

10. The faucet hose adapter of claim 9, wherein the first end comprises an elastic material configured to selectively move between an expanded position and a retracted position, wherein a diameter of the first end is greater when the first end is in the expanded position, such that the first end frictionally engages the faucet when in the retracted position.

11. The faucet hose adapter of claim 1, further comprising a spray nozzle affixed to the second end, wherein the spray nozzle comprises a plurality of openings on a distal end of the spray nozzle.

12. The faucet hose adapter of claim 11, wherein a proximal end of the spray nozzle comprises a smaller diameter than the distal end of the spray nozzle.

13. The faucet hose adapter of claim 11, wherein a proximal end of the spray nozzle is removably securable to the second end.

14. The faucet hose adapter of claim 9, wherein a flexibility of the elongated tube varies along a length of the elongated tube, such that the flexibility at the second end is greater than at the first end.

15. The faucet hose adapter of claim 9, further comprising a sponge attachment removably securable to the second end.

16. The faucet hose adapter of claim 9, wherein the rigid base further comprises a planar rear surface configured to rest flush against a wall surface.

17. The faucet hose adapter of claim 9, wherein the rigid base is configured to resemble an animal.

18. The faucet hose adapter of claim 9, wherein a front surface of the base comprises indicia thereon configured to entertain a child.

* * * * *